US006644537B1

(12) United States Patent
Chiu et al.

(10) Patent No.: US 6,644,537 B1
(45) Date of Patent: Nov. 11, 2003

(54) MANUFACTURING METHOD FOR BONDED ELECTROFORMING METALLIC MOLD

(75) Inventors: Shao Chen Chiu, Taichung (TW); Hsiharng Yang, Taipei (TW); Chi Feng Cheng, Yi-Lan (TW)

(73) Assignee: Taiwan Green Point Enterprise Co., Ltd., Taichung (TW)

( * ) Notice: Subject to any disclaimer, the term of this patent is extended or adjusted under 35 U.S.C. 154(b) by 0 days.

(21) Appl. No.: 10/135,531

(22) Filed: May 1, 2002

(51) Int. Cl.[7] ..... B23K 31/00; C25D 1/10

(52) U.S. Cl. ..... 228/256; 228/249; 205/114; 205/70

(58) Field of Search ..... 205/114, 122, 205/70; 204/483; 427/123, 124, 142, 154, 156, 133, 135, 401; 228/245–262, 225; 219/121.11, 148, 162

(56) References Cited

U.S. PATENT DOCUMENTS 4,349,145 A * 9/1982 Shinopulos et al. ..... 228/208
5,242,099 A * 9/1993 Ueda ..... 228/123.1
5,501,784 A * 3/1996 Lessmollmann et al. ..... 205/67
5,632,878 A * 5/1997 Kitano ..... 205/70
5,783,259 A * 7/1998 McDonald ..... 427/447

FOREIGN PATENT DOCUMENTS

JP 61127885 A * 6/1986

* cited by examiner

*Primary Examiner*—M. Alexandra Elve
*Assistant Examiner*—Kevin McHenry
(74) *Attorney, Agent, or Firm*—Rosenberg, Klein & Lee

(57) ABSTRACT

Manufacturing method for bonded electroforming metallic mold, including steps of: 1. preparation of metallic material 2. preparation of electroforming metallic plate and plastic mold core and electroforming substrate; 3. preparation of power supply; 4. forming of electroforming deposited film; and 5. final-shaping. In order to significantly shorten the electroforming time and firmly connect with the steel material of the mold, the steel material of the mold and the electroforming article are simultaneously electrically connected to the cathodes of power supplies. So, the electroforming metal is simultaneously deposited on both sides to quickly achieve the desired thickness of the electroforming metallic plate. By the metal-to-metal bonding force, the electroforming metallic plate and the steel material of the mold are firmly connected with each other. Also, the electroforming metallic plate keeps having the original cast pattern and is tightly combined with the steel material of the mold.

5 Claims, 5 Drawing Sheets

MANUFACTURING METHOD FOR BONDED ELECTROFORMING METALLIC MOLD

BACKGROUND OF THE INVENTION

The present invention is related to a manufacturing method for electroforming metallic mold, and more particularly to a manufacturing method for bonded electroforming metallic mold. By means of the manufacturing method, the connecting interface of the mold is rigid and firm as well as the processing is significantly speeded. In addition, the connecting interface is uneasy to deform under high temperature.

The existent measures for connecting an electroforming metallic plate with a steel mold core by way of electroforming respectively have some shortcomings as follows:

In the case of vacuum sucking method, the demanded thickness of the electroforming plate can be quickly achieved. However, the mold must be very precisely manufactured, an additional expensive vacuum equipment is required, and the maintenance of the mold is quite difficult.

In the case of flame fusion injection or laser welding method, the electroforming metallic plate will be deformed and will damage the surface profile of the electroforming metallic plate.

Alternatively, in the case of mechanical insertion or screw tightening method, the electroforming metallic plate must have a considerably thickness. As a result, the electroforming time will be considerably lengthy.

By using the conventional electroforming method, of course an electroforming metallic plate with a sufficient thickness can be formed, For example, the thickness is 3 mm (3000 $\mu$m) and the growth rate of electroforming is 0.4 $\mu$m per minute. The deposition is one-way performed, so that theoretically it needs 7500 minutes to complete the deposition. In other words, the deposition will take 125 hours, that is, 5.2 days. Therefore, it is very time-consuming. Furthermore, after electroforming, the internal stress is still remained in the thick material so that the deposited material tends to deform.

Please refer to FIG. 1. A previously designed and manufactured plastic mold core 92 is disposed on an electroforming substrate 91. Insulated plates 93 are disposed on its two sides. After completing the electroforming procedure, the original extremely thin electroforming metallic film 90 becomes quite thick (assuming its thickness grows up from several hundreds $\mu$m to 3 mm). Under such circumstance, the internal stress will be remained, so the deposited material tends to deform as shown in the exaggerated view of FIG. 1.

Therefore, it is necessary to develop a new measure to solve the above problems.

SUMMARY OF THE INVENTION

It is therefore a primary object of the present invention to provide a manufacturing method for bonded electroforming metallic mold. In this manufacturing method, a metallic material with a considerable thickness is utilized and the electroforming deposition is simultaneously inward (two-way) performed on two connecting faces. After the electroforming deposition procedure is done, the bonding interface is rigid and firm, and the manufacturing time for the mold is significantly shortened.

It is a further object of the present invention to provide a manufacturing method for bonded electroforming metallic mold. By using this manufacturing method, the connecting interface is uneasy to deform under high temperature.

According to the above objects, the manufacturing method for bonded electroforming metallic mold of the present invention includes steps of: 1. preparation of metallic material 2. preparation of electroforming metallic plate and plastic mold core and electroforming substrate; 3. preparation of power supply; 4. forming of electroforming deposited film; and 5. final-shaping.

The present invention can be best understood through the following description and accompanying drawings wherein:

DETAILED DESCRIPTION OF THE PREFERRED EMBODIMENTS

Figure 1:
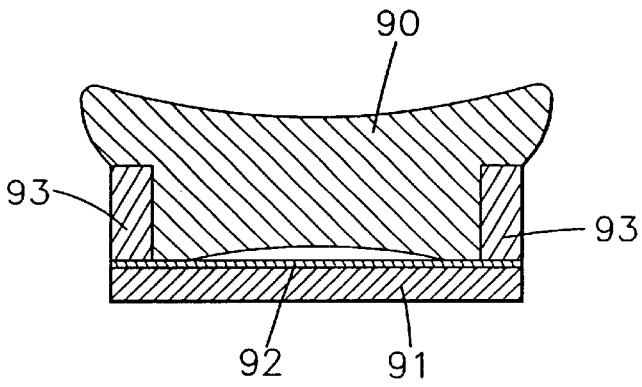
FIG. 1 (PRIOR ART)
FIG. 1 is a sectional view showing that the thick electroforming metallic mold manufactured by the conventional method is deformed.
Figure 2:
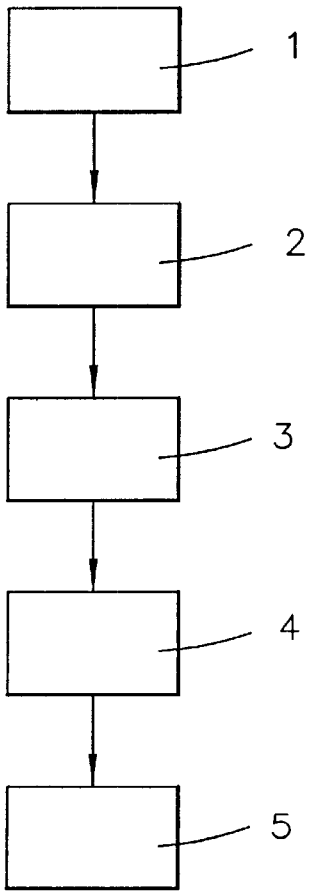
FIG. 2 is a flow chart of the present invention.
Figure 3:
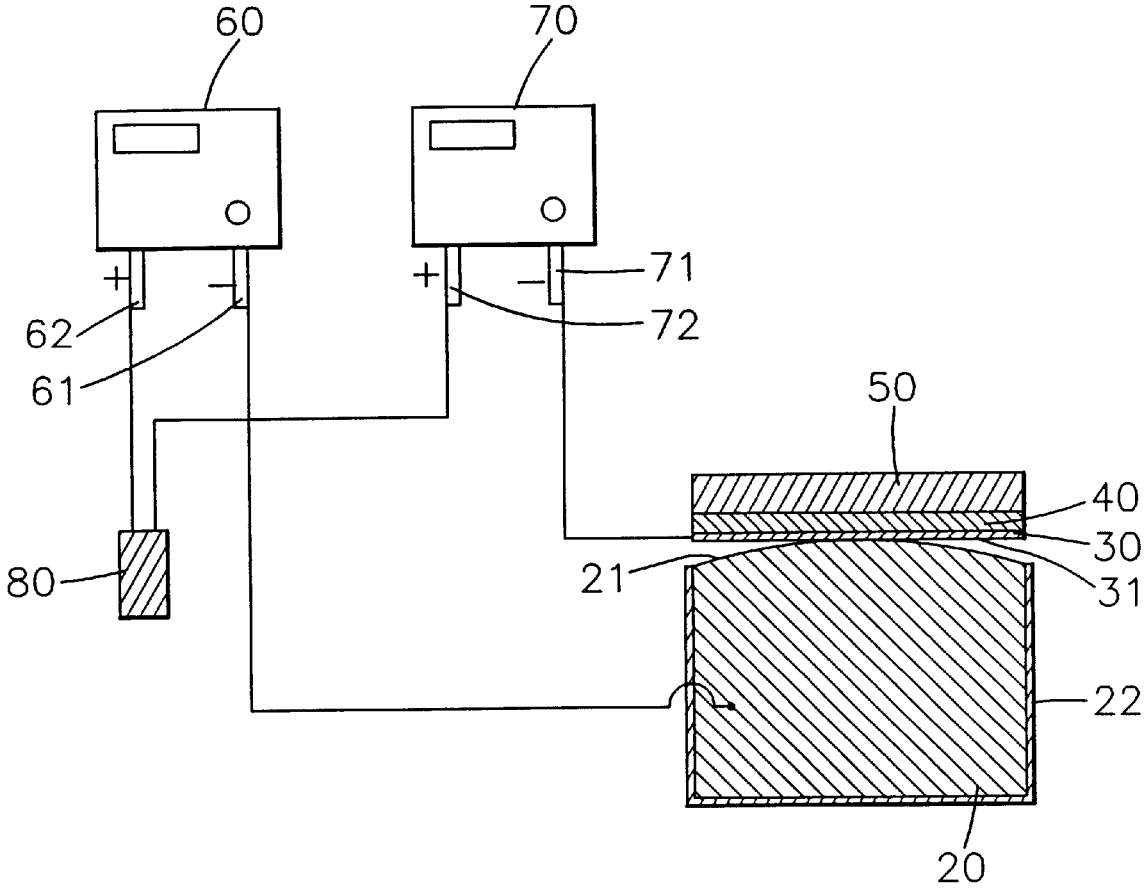
FIG. 3 shows the arrangement of the present invention prior to electroforming.

Please refer to FIG. 2. The manufacturing method for bonded electroforming metallic mold of the present invention includes steps of: 1. preparation of metallic material 1; 2. preparation of electroforming metallic plate and plastic mold core and electroforming substrate 2; 3. preparation of power supply 3; 4. forming of electroforming deposited film 4; and 5. final-shaping 5. The respective steps will be described as follows:

1. Preparation of metallic material 1: Referring to FIG. 3, a conductive metallic material 20 (such as steel, copper, etc.) with a predetermined thickness is prepared. The metallic material 20 has a slightly convex first connecting face 21. The other faces of the metallic material 20 are coated with an insulated film 22. The metallic material 20 has a thickness at least over 1 mm, whereby the metallic material 20 can be conveniently clamped by a clamp in successive procedure.
2. Preparation of electroforming metallic plate and plastic mold core and electroforming substrate 2: An electroforming metallic plate 30 with an average thickness smaller than 500 $\mu$m is prepared. The electroforming metallic plate 30 has a second connecting face 31 corresponding to the first connecting face 21 and a processed surface 32. A nonconductive plastic mold core 40 (or called mold insert) and a nonconductive electroforming substrate 50 are connected on the processed surface 32 of the electroforming metallic plate 30. These three elements (20, 30 & 40) are temporarily combined together. The processed surface 32 of the electroforming metallic plate 30 is formed with a structure with a predetermined shape or pattern with a specific profile. (For example, the structures can be a specific microstructure for forming a photoconductive module in successive manufacturing procedure.)

Figure 4:
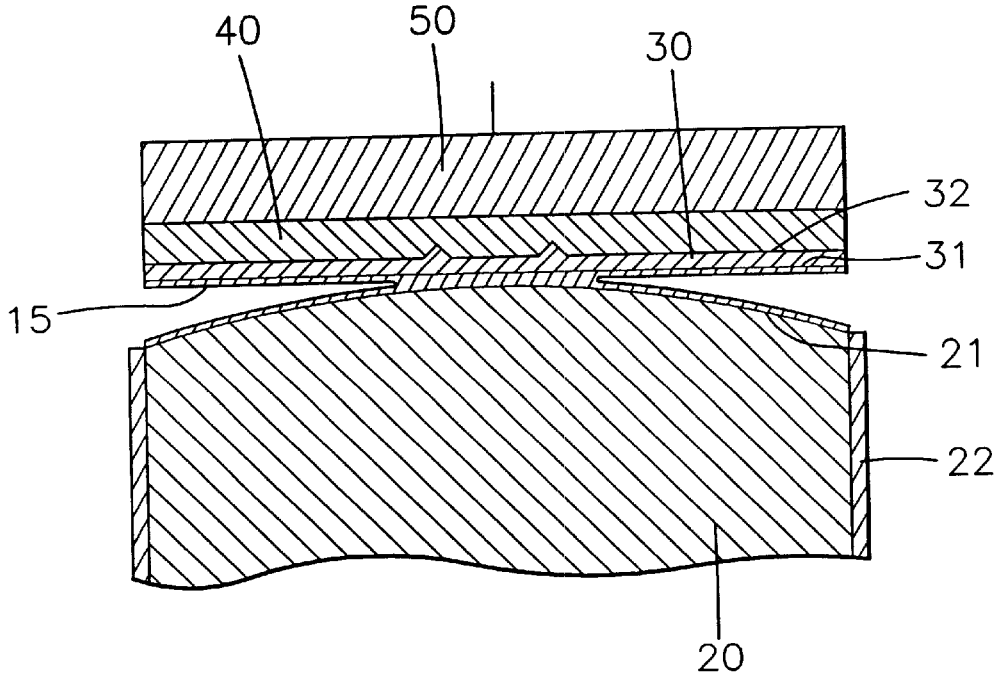
FIG. 4 is an enlarged view of a part of the present invention during electroforming in one state.
Figure 5:
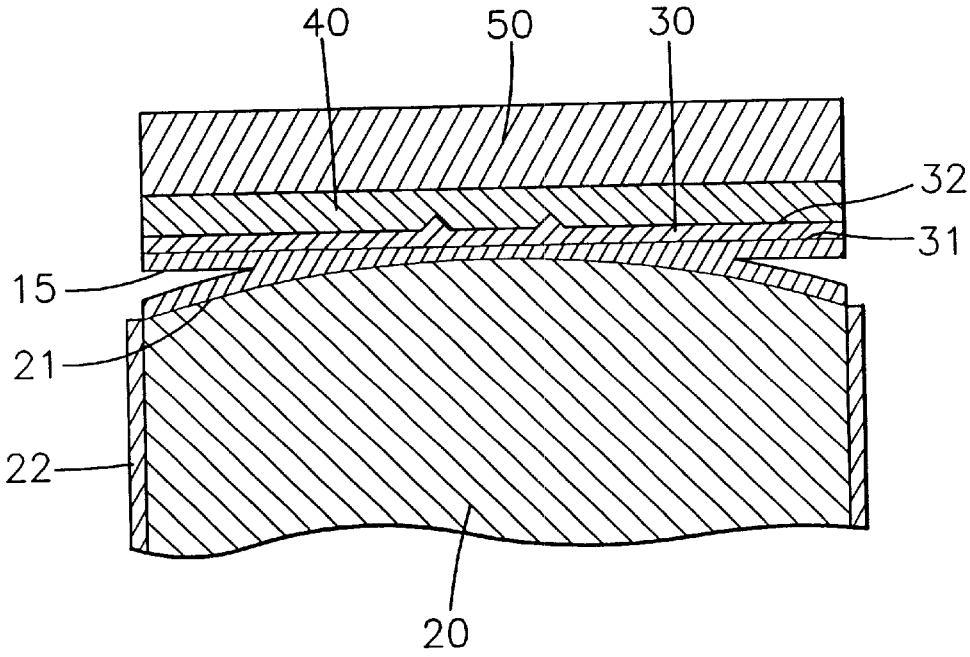
FIG. 5 is an enlarged view of a part of the present invention during electroforming in another state.
Figure 6:
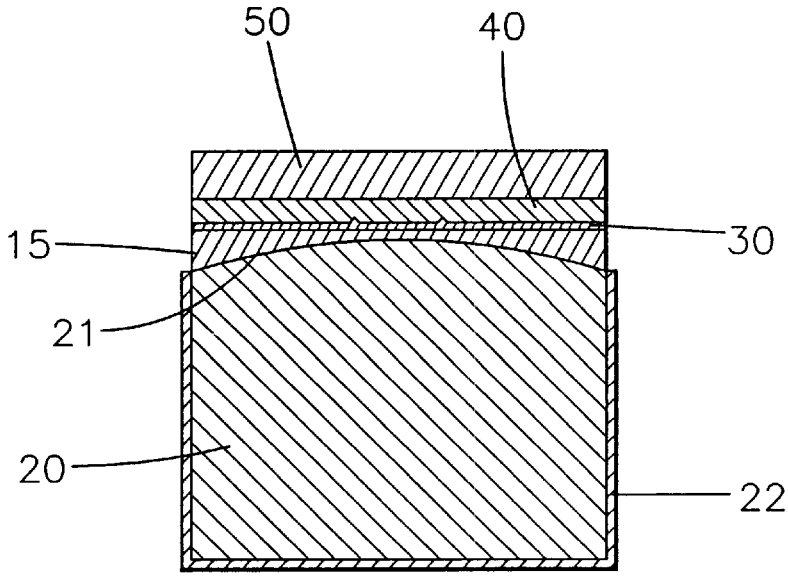
FIG. 6 is an enlarged view of a part of the present invention, showing that the electroforming is completed.
Figure 7:
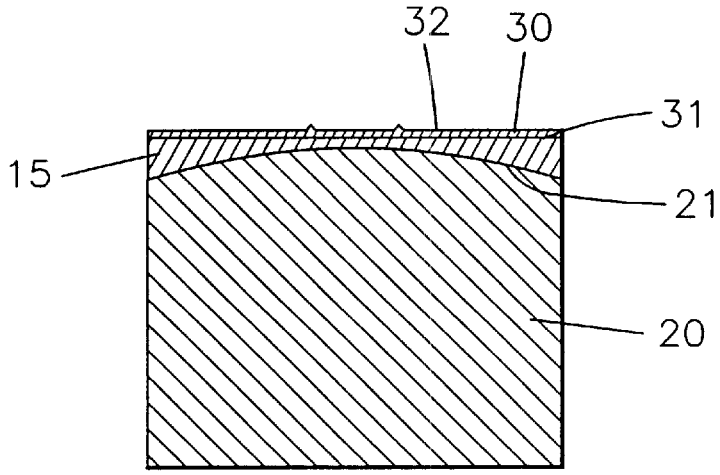
FIG. 7 shows a state of the present invention after final-shaping.

3. Preparation of power supply 3: Two power supplies 60, 70 are prepared. Each power supply 60, 70 has a cathode 61, 71 and an anode 62, 72.
4. Forming of electroforming deposited film 4: Please refer to FIGS. 3, 4 and 5. The slightly convex first connecting face 21 contacts with the second connecting face 31 by a predetermined small area to perform electroforming procedure. While performing this electroforming procedure, the anodes 62, 72 of the two power supplies 60, 70 are electrically connected an electroforming material source 80 (such as nickel). In addition, the metallic material 20 and the electroforming metallic plate 30 are respectively electrically connected with the cathodes 61, 71 of the two power supplies 60, 70. Both are simultaneously gradually deposited in the space between the first connecting face 21 of the metallic material 20 and the second connecting section 31 of the electroforming metallic plate 30. Furthermore, referring to FIGS. 5 and 6, when the two-way deposited material becomes thicker and thicker, by means of the metal-to-metal bonding force of the newly formed electroforming deposited film 15, the metallic material 20 and the electroforming metallic plate 30 are tightly bonded together. Accordingly, the metallic material 20, the electroforming deposited film 15, the electroforming metallic plate 30, the plastic mold core 40 and the non-conductive electroforming substrate 50 are sequentially integrally combined.
5. Final-shaping 5: Please see FIG. 7. In this step, the non-conductive plastic mold core 40 and the electroforming substrate 50 as well as the insulated film 22 are removed. It is defined as final-shaping. That is, the electroforming metallic plate 30 is obtained to keep having the original cast processed surface 22 and is also tightly connected with the metallic material 20 by means of the electroforming deposited film 15 so that a bonded electroforming metallic mold is formed.

Moreover, the material of the electroforming substrate 50 can be selected from one of the nonconductive materials of silicon, silicon dioxide, glass, quartz, plastic and epoxy resin.

In practice, for a more sophisticated mold such as photoconductive module of liquid crystal display (LCD), the thickness of the metallic material is usually within about 2–3 mm and the thickness of the electroforming metallic plate is usually within 250 $\mu$m–350 $\mu$m.

Figure 8:
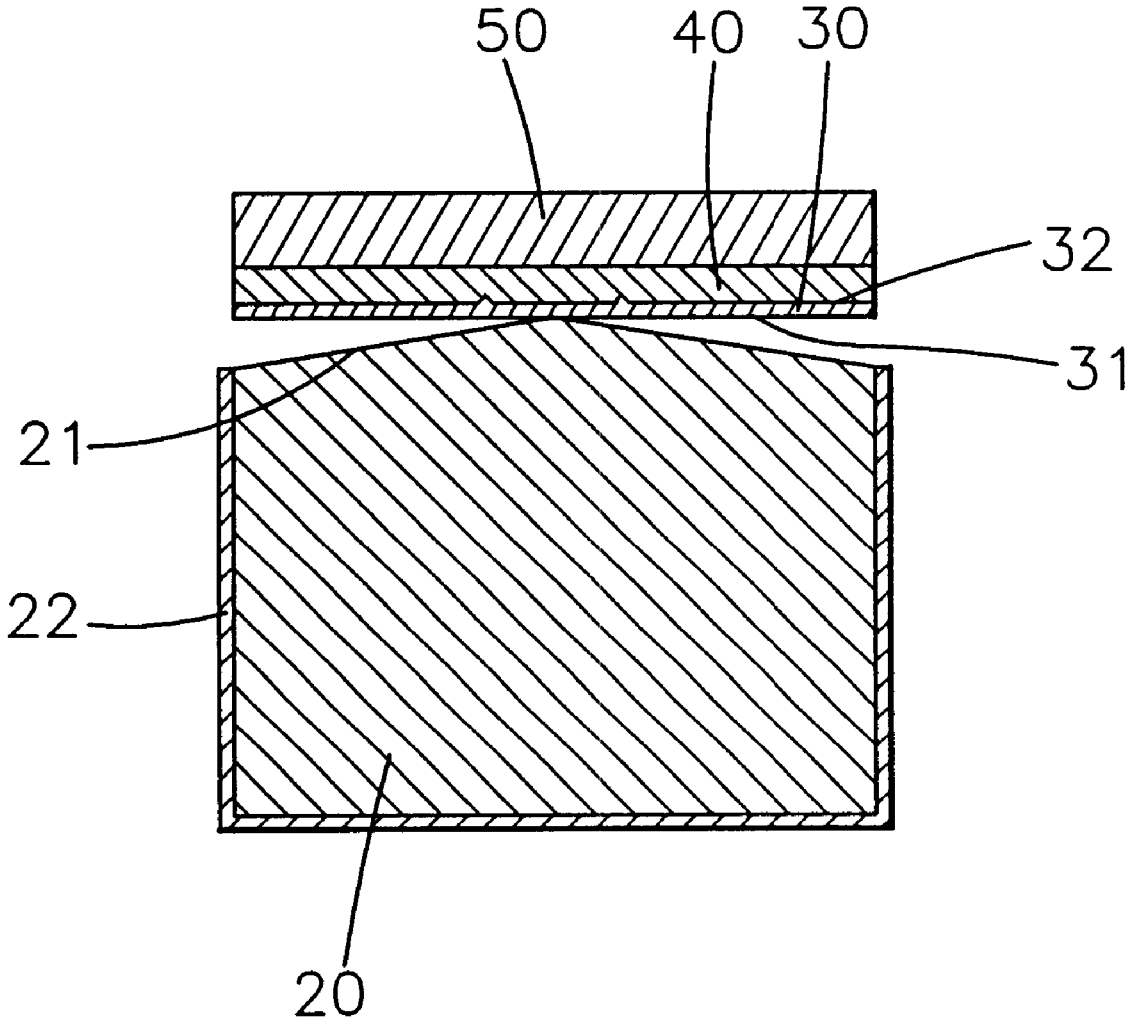
FIG. 8 is an enlarged view of a part of another embodiment of the present invention.

FIG. 8 shows a second embodiment of the present invention. In which, the first connecting face 21 is a slightly conic face, while the second connecting face 31 is a plane face in contact with the first connecting face 21 by a small area.

In addition to the above photoconductive module, the present invention is still applicable to other related fields such as headlight module of a vehicle, which requires fine pattern on the surface (for fogging and diverging light beam penetrating through the surface). Alternatively, the present invention is applicable to laser full-image film, etc.

In conclusion, the present invention has the following advantages and functions:

1. The connecting interface is rigid and firm. The connecting force of the electroforming deposited film 15 is the internal metallic bonding force of the metal material. Therefore, the metallic material 20 and the electroforming metallic plate 30 can be very firmly connected with each other. Accordingly, the using life of the bonded electroforming metallic mold is prolonged.
2. The processing is speeded. The major thickness of the present invention (assuming it is 2.5 mm, for clamping) is provided by the existent metallic material 20. Therefore, the required thickness of the deposited material is quite small. Assuming the required thickness is 0.5 mm (500 $\mu$m) and the growth rate is 0.4 $\mu$m per minute, since the deposited material grows simultaneously inward from two opposite inner surfaces, the required thickness on one side is only 250 $\mu$m. Then, divided by 0.4 $\mu$m/second, theoretically it will cost 625 minutes (about 10.4 hours) to complete the deposition. In comparison with the total time of 7500 minutes (about 125 hours equal to 5.2 days) cost for completing the electroforming of 3 mm (2.5 mm+0.5 mm) thickness of deposited material in the conventional manufacturing method, the processing speed of the present invention is about 12 times faster than the processing speed of the conventional manufacturing method. Therefore, the processing time for the mold is significantly shortened.
3. The connecting interface is uneasy to deform under high temperature. The connecting interface pertains to metal-to-metal bonding connection by way of electroforming deposition. After it is connected, in the successive processing procedure, the connecting interface is high temperature durable and uneasy to deform.

The above embodiments are only used to illustrate the present invention, not intended to limit the scope thereof. Many modifications of the above embodiments can be made without departing from the spirit of the present invention.

What is claimed is:

1. Manufacturing method for bonded electroforming metallic mold, comprising steps of:

preparation of metallic material: preparing a conductive metallic material with a predetermined thickness, the metallic material having a first connecting face that is slightly convex, other faces of the metallic material being coated with an insulated film, the metallic material having a thickness at least over 1 mm;

preparation of electroforming metallic plate and plastic mold core and electroforming substrate: preparing an electroforming metallic plate with an average thickness smaller than 500 $\mu$m, the electroforming metallic plate having a second connecting face corresponding to the first connecting face and a processed surface, a non-conductive plastic mold core and a nonconductive electroforming substrate being connected on the processed surface of the electroforming metallic plate and temporarily combined together, the processed surface of the electroforming metallic plate being formed with a structure with a predetermined shape or pattern with a specific profile;

preparation of power supply: preparing two power supplies, each power supply having a cathode and an anode;

forming of electroforming deposited film: making the slightly convex first connecting face contact with the second connecting face by a predetermined small area to perform a electroforming procedure, when performing this electroforming procedure, the anodes of the two power supplies being electrically connected to an electroforming material source, the metallic material and the electroforming metallic plate being respectively electrically connected with the cathodes of the two power supplies, both being simultaneously gradually deposited in a space between the first connecting face of the metallic material and the second connecting face of the electroforming metallic plate, when a two-way deposited material becomes thicker and thicker, by means of a metal-to-metal bonding force of an electroforming deposited film, the metallic material and the electroforming metallic plate being tightly bonded with each other, whereby the metallic material, the electroforming deposited film, the electroforming metallic plate, the plastic mold core and the non-conductive electroforming substrate are sequentially integrally combined; and final-shaping: removing the non-conductive plastic mold core and the electroforming substrate, that is defined as final-shaping, and making the electroforming metallic plate keep having the original cast processed surface and tightly connected with the metallic material by means of the electroforming deposited film to form a bonded electroforming metallic mold.

2. Manufacturing method for bonded electroforming metallic mold as claimed in claim 1, wherein a material of the electroforming substrate is selected from one of non-conductive materials of silicon, silicon dioxide, glass, quartz, plastic and epoxy resin.

3. Manufacturing method for bonded electroforming metallic mold as claimed in claim 1, wherein a thickness of the metallic material is within 2–3 mm and a thickness of the electroforming metallic plate is within 250 $\mu$m–350 $\mu$m.

4. Manufacturing method for bonded electroforming metallic mold as claimed in claim 1, wherein the first connecting face is a slightly convex face and the second connecting face is a plane face.

5. Manufacturing method for bonded electroforming metallic mold as claimed in claim 1, wherein the first connecting face is a slightly conic face, while the second connecting face is a plane face.

* * * * *